US007108366B2

(12) United States Patent
Ishikawa

(10) Patent No.: US 7,108,366 B2
(45) Date of Patent: Sep. 19, 2006

(54) IMAGE RECORDING METHOD AND IMAGE RECORDING DEVICE

(75) Inventor: Wataru Ishikawa, Hino (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 306 days.

(21) Appl. No.: 10/836,003

(22) Filed: Apr. 29, 2004

(65) Prior Publication Data

US 2004/0223041 A1 Nov. 11, 2004

(30) Foreign Application Priority Data

May 8, 2003 (JP) ..... 2003-130165
Apr. 1, 2004 (JP) ..... 2004-108964

(51) Int. Cl.
*B41J 2/01* (2006.01)

(52) U.S. Cl. ..... 347/102; 347/17

(58) Field of Classification Search ..... 347/5, 347/6, 17, 102
See application file for complete search history.

(56) References Cited

U.S. PATENT DOCUMENTS

2005/0018026 A1* 1/2005 Nerad et al. ..... 347/102

* cited by examiner

*Primary Examiner*—Stephen Meier
*Assistant Examiner*—Ly T Tran
(74) *Attorney, Agent, or Firm*—Frishauf, Holtz, Goodman & Chick, P.C.

(57) ABSTRACT

An image recording method includes: jetting light curable ink on a recording medium by a recording head of an inkjet type; irradiating light from a light source toward the recording medium; and curing the light curable ink to form an image, wherein at least one of light intensity of the light source and light curability of the light curable ink is adjusted so as to make viscosity increase rate of the light curable ink not less than 20% after the light source irradiates the light directly toward the light curable ink for a first predetermined time period; and light intensity at a jetted surface of the recording head is adjusted so as to make the viscosity increase rate of the light curable ink from 5% to 30% after light having the light intensity at the jetted surface is irradiated toward the light curable ink for a second predetermined time period.

8 Claims, 5 Drawing Sheets

IMAGE RECORDING METHOD AND IMAGE RECORDING DEVICE

BACKGROUND OF THE INVENTION

1. Field of the Invention

This invention relates to an image recording method and an image recording device, in particular, an image recording method and an image recording device which form an image with the use of light curable ink.

2. Description of the Related Art

In an image recording device which records an image by jetting ink such as an inkjet printer and the like, jet openings for jetting ink to a recording medium are arranged at one side (jetting side) of recording heads. In order to recover from clogging at the jet openings due to, for example, increase of ink viscosity, ink fixing, air bubbles and dust generated in a fluid path to the jet openings and the like, various types of maintenance are performed to the recording heads. As the maintenance, for example, wipe for removing dust or the liked adhering on the jetting side, vacuum for vacuuming and removing the air bubbles stagnating in the fluid path together with the ink with a cap member covering the jetted surface of the recording head, dummy jetting for jetting ink from the jet openings toward the cap member and the like can be cited. By executing these types of maintenance, it is possible to form a high quality image for a long time period.

In recent years, an inkjet printer which performs image formation with the use of light curable ink has been developed. With the use of light curable ink, after the image formation, light irradiation cures the light curable ink, and thereby it is possible to make a formed image hard to disappear for a long time period. This is very whether-resistant and thereby it is effective when a formed image is placed outdoor or the like (for example, see Japanese Patent Application Publication (Unexamined) No. Tokukai-Hei 6-344544).

Here, when light curable ink is used, because of its light curability, the ink can easily have influence from faint light (leaked light) dispersed from a light source. In particular, if the leaked light reaches the jetted surface, there is a possibility of-making the light curable ink located at the jetted surface and the jet openings have high viscosity and further cured. Therefore, in order to form a high quality image for a long time period, it is necessary to increase frequency of the maintenance. However, if the frequency of maintenance is increased, consumed ink for the dummy jetting and maintenance hours are increased, and thereby, it is not possible to perform image formation effectively.

SUMMARY OF THE INVENTION

An object of the present invention is to provide an image recording method and an image recording device capable of high-speed image formation by restraining increase of number of times of maintenance in the case of using light curable ink.

In accordance with a first aspect of the present invention, an image recording method, comprises: jetting light curable ink on a recording medium by a recording head of an inkjet type; irradiating light from a light source toward the recording medium; and curing the light curable ink to form an image, wherein at least one of light intensity of the light source and light curability of the light curable ink is adjusted so as to make viscosity increase rate of the light curable ink not less than 20% after the light source irradiates the light directly toward the light curable ink for a first predetermined time period; and light intensity at a jetted surface of the recording head is adjusted so as to make the viscosity increase rate of the light curable ink from 5% to 30% after light having the light intensity at the jetted surface is irradiated toward the light curable ink for a second predetermined time period which is longer than the first predetermined time period.

In accordance with a second aspect of the present invention, an image recording device comprises: a recording head of an inkjet type, for jetting light curable ink toward a recording medium; and a light source for irradiating light toward the light curable ink jetted on the recording medium to cure the light curable ink, wherein at least one of light intensity of the light source and light curability of the light curable ink is adjusted so as to make viscosity increase rate of the light curable ink not less than 20% after the light source irradiates the light directly toward the light curable ink for a first predetermined time period, and light intensity at a jetted surface of the recording head is adjusted so as to make the viscosity increase rate of the light curable ink from 5% to 30% after light having the light intensity at the jetted surface is irradiated toward the light curable ink for a second predetermined time period which is longer than the first predetermined time period.

According to the method of the first aspect and the device of the second aspect, when light with light intensity at the jetted surface of the recording head, that is, light corresponding to leaked light, is irradiated toward the light curable ink for the second predetermined time period, the light intensity at the jetted surface of the recording head is adjusted so as to make viscosity increase rate of the light curable ink from 5% to 30%. Therefore, after the second predetermined time period has passed, although the viscosity of the light curable ink is increased up to from 5% to 30%, the ink is not entirely cured. Thereby, it is possible to perform the maintenance at least within the second predetermined time period. As a result, if the second predetermined time period is set as long a time period as possible, even in the case of using the light curable ink, it is possible to restrain the increase of number of times of maintenance, and thereby high-speed image formation is possible.

Preferably, in the method of the first aspect of the present invention and in the device of the second aspect of the present invention, the light curable ink includes cationic polymerizing type ink.

According to the above-mentioned method and device, as the light curable ink, cationic polymerizing type ink, radical polymerizing type ink and the like can be cited. Among them, in view of adhesiveness, odor and light curability in regard to ink, cationic polymerizing type ink is preferably used. Since cationic polymerizing type ink gets cured with lower light intensity than that necessary for radical polymerizing type ink, it is possible to reduce output of the light source and thereby it is possible to achieve energy saving. However, due to its light curability, cationic polymerizing type ink is sensitive to faint light (leaked light) dispersed from the light source. However, even in the case of using cationic polymerizing type ink, when light with light intensity at the jetted surface of the recording head, that is, light corresponding to leaked light, is irradiated toward the light curable ink for the second predetermined time period, the light intensity at the jetted surface of the recording head is adjusted so as to make viscosity increase rate of the light curable ink from 5% to 30%. Thereby, if the second predetermined time period is set as long a time period as possible, it is possible to restrain the increase of number of times of maintenance, and thereby high-speed image formation is possible.

Preferably, in the method of the first aspect of the present invention, the first predetermined time period is not more than 0.1 second, and the second predetermined time period is not less than 10000 seconds.

According to the above-mentioned method, if the first predetermined time period is set to not more than 0.1 second, when light is irradiated toward light curable ink dropped on a recording medium for 0.1 second, viscosity of the light curable ink is increased up to not less than 20%. By having such a curing reaction, it is possible to form a high resolution image with color bleeding restrained.

Further, since the second predetermined time period is set to not less than 10000 seconds, even in the case of using light curable ink, it is possible to restrain the increase of number of times of maintenance securely for a long period, and thereby high-speed image formation is possible.

Preferably, in the method of the first aspect of the present invention, at least one of the light intensity of the light source and the light curability of the light curable ink is adjusted so as to cure the light curable ink after the light source irradiates the light directly toward the light curable ink for a time period not less than the first predetermined time period and not more than 1.0 second.

According to the above-mentioned method, since light curable ink is cured when the light source directly irradiates light toward the ink for not less than first predetermined time period and not more than 1.0 second, it is possible to form a high resolution image at high speed.

Preferably, in the method of the first aspect of the present invention, the light intensity at the jetted surface of the recording head is adjusted by adjusting at least one of a distance between the recording head and the light source, and an irradiation angle of the light source.

According to the above-mentioned method, by adjusting at least one of the distance between the recording head and the light source, and the irradiation angle of the light source, it is possible to reduce the cost, for example, more than the case of adjusting light intensity with a douser or the like.

Preferably, in the method of the first aspect of the present invention, the distance between the recording head and the light source is set to from 1 cm to 10 cm.

According to the above-mentioned method, the smaller the light intensity reaching the recording head is, the more difficult the curing of the light curable ink on the jetted surface becomes. Therefore, if the distance between the recording head and the light source set to not less than 1 cm so as to make an irradiation path of leaked light longer, it is possible to reduce light intensity of leaked light reaching the recording head. However, if the distance is set to too long, it is not possible to achieve miniaturization of the device. Therefore, as mentioned, if the distance between the recording head and the light source is set to from 1 cm to 10 cm, it is possible to reduce light intensity of leaked light reaching the recording head with miniaturization still achieved.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

PREFERRED EMBODIMENT OF THE INVENTION

Hereinafter, an embodiment of the present invention will be described with reference to figures. Here, what is written hereafter is not intended to limit a technical range or the meanings of words in claims. Further, the assertive description in the embodiment of the present invention is intended to indicate the best mode, not intended to limit the meanings of words or a technical range of the present invention.

Figure 1:
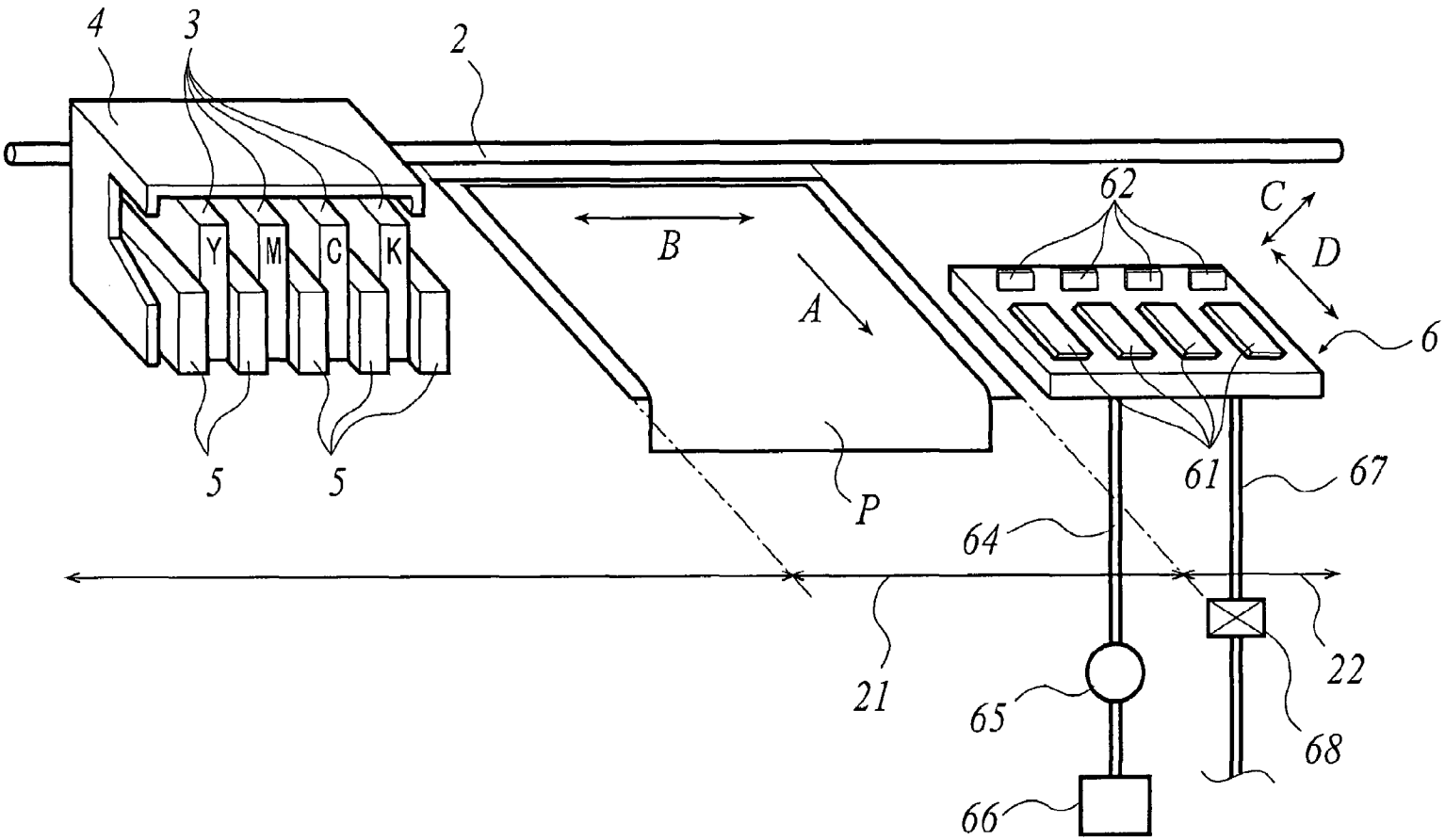
FIG. 1 is a perspective view showing a rough structure of an image recording device according to the present invention.

An image recording device 1 is an inkjet printer to which a serial type is applied. As shown in FIG. 1, the image recording device 1 comprises a conveyance device for conveying a recording medium P along a conveyance direction A. Above the recording medium P being conveyed by the conveyance device, placed is a guide rail 2 extending in a direction orthogonal to the conveyance direction A (scanning direction B). On the guide rail 2, placed is a carriage 4 on which a plurality of recording heads 3 are placed along the scanning direction B so as to be movable back and forth.

Figure 2:
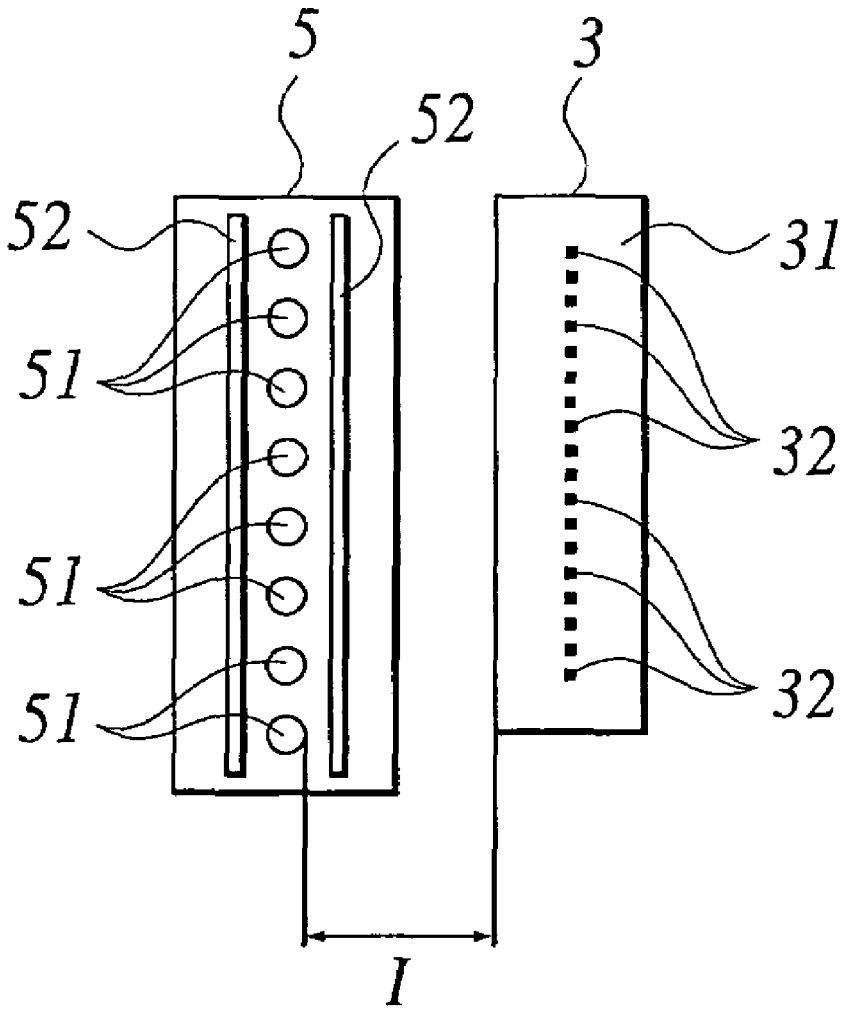
FIG. 2 is a bottom view showing a light irradiation device and a recording head included in the image recording device of FIG. 1.

The plurality of recording heads 3 jet light curable ink of yellow (Y), magenta (M), cyan (C) and black (Bk) respectively, as a droplet of 8 pl/drop, for example. On a jetted surface of each of the recording heads 3, as shown in FIG. 2, a plurality of jet openings 32 for jetting light curable ink are arranged along the conveyance direction A. At both the sides of each recording head 3, as shown in FIG. 1, placed are light irradiation devices 5 for irradiating light toward the recording medium P.

On the light irradiation device 5, as shown in FIG. 2, a plurality of light sources 51 are arranged along the conveyance direction A. At both the sides of the light sources 51, placed are shielding plates 52 for preventing light from dispersing. Here, as the light source, preferably a light source irradiating ultraviolet rays is used, for example, a fluorescent tube, a low-pressure mercury lamp, LD, LED and the like.

As shown in FIG. 1, the center part of the movable range of the carriage 4 is regarded as a formation area 21 where image formation is performed on the recording medium P. One of the outside parts of the forming-area 21 within the movable range of the carriage 4 is regarded as a maintenance area 22.

In the maintenance area 22, placed is a maintenance unit 6 for performing various types of maintenance such as wipe, vacuum, dummy jetting and the like. Above the maintenance unit 6, cap members 61 for covering the jetted surface 31 of the recording heads 3 are placed so as to face the recording heads 3 being moved to the maintenance area 22 by the carriage 4. Further, near one edge of the cap members 62, placed are blades 62 for performing the wipe to light curable ink remaining on the jetted surface 31. The cap members 61 and the blades 62 are respectively arranged as many as the recording heads 3. Further, the maintenance unit 6 comprises a maintenance driving force 62 (see FIG. 3), and the maintenance driving force 62 moves the maintenance unit 6 in an up-down direction C and a front-back direction D for performing the various types of maintenance.

Inside of the cap member 61, placed is an absorber (illustration omitted) for absorbing light curable ink with being contacted to the jetted surface 31 when the cap member 61 covers the jetted surface 41. The absorber is formed with porous resin to which a hydrophilic process such as Bell-H (a product name by Kanebo) is applied.

At the bottom side of the cap member 61, placed is an ink communicating tube 64 for communicating from inside of the cap member 61. In the middle of the ink communicating tube 64, place is an vacuuming pump 65 as a vacuuming device, and at the lower end of the ink communicating tube 64, placed is a deteriorated ink tank 66 for receiving the vacuumed light curable ink. In addition, at the bottom side of the cap member 61, placed is an air communicating tube 67 communicating from inside of the cap member 61, and in the middle of the air communicating tube, placed is an air communicating valve 68.

Figure 3:
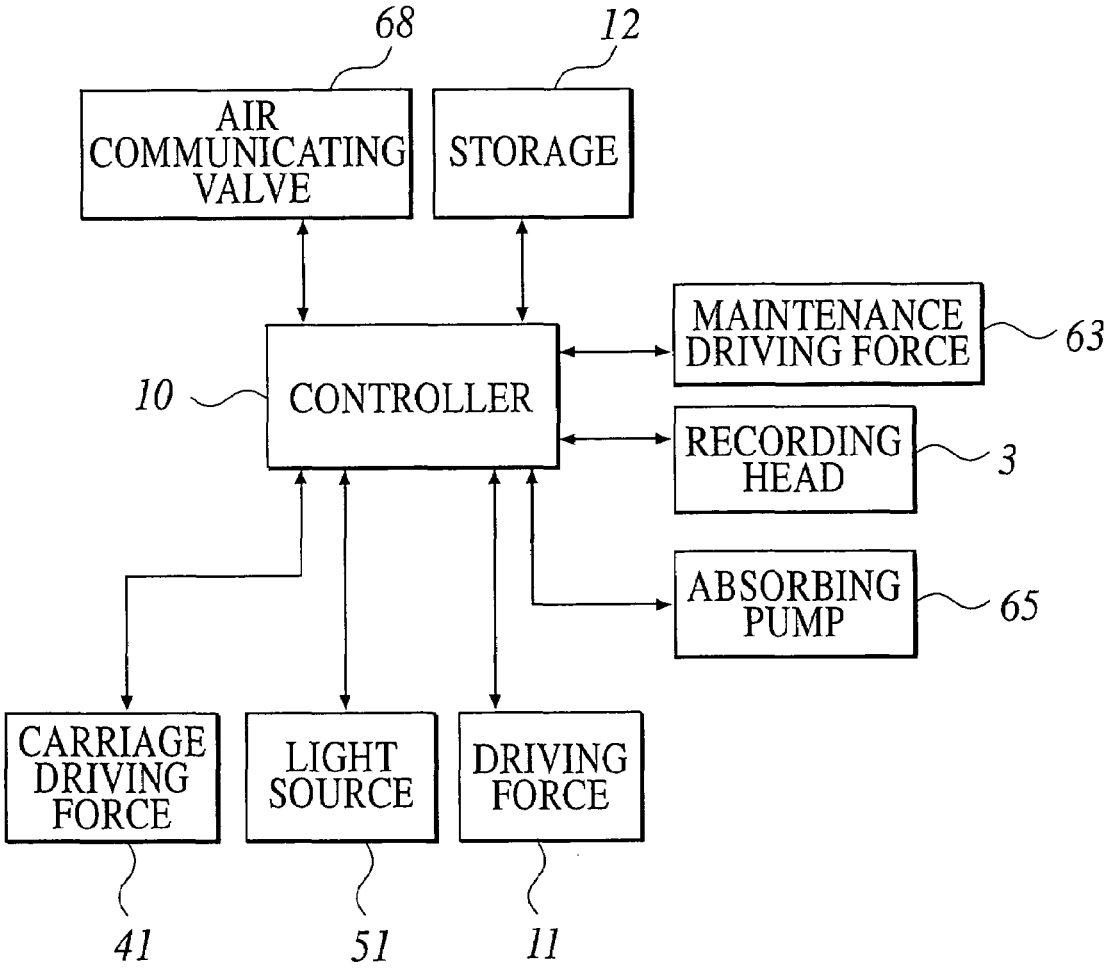
FIG. 3 is a block diagram showing a main control structure of the image recording device of FIG. 1.

Next, with reference to FIG. 3, a main control structure of the image recording device 1 will be described. FIG. 3 is a block diagram showing the main control structure of the image recording device 1.

The image recording device 1, as shown in FIG. 3, comprises a controller 10 for controlling each driving unit. A driving force 11 for a conveyance device, a carriage driving force 41 of the carriage 4, a storage 12, the recording head 3, a light source 51, the maintenance driving force 63, the absorbing pump 65 and the air communicating valve 68 are electrically connected to the controller 10. Here, in addition to these units, each driving unit of the image recording device 1 is connected to the controller 10.

Then, the controller 10 controls each driving unit according to a control program and control data written in the storage 12.

Here, for example, when light having a certain light intensity is irradiated to different types of light curable ink having different light curability from each other for a certain period of time, the higher light curability the ink has, the more viscosity increases after the irradiation. On the other hand, when light is irradiated to light curable ink having the same light curability for a certain period of time, the more intensity the light having is irradiated, the more viscosity increases after the irradiation. Further, when light is irradiated for different periods of time, the longer the light is irradiated for, the more viscosity increases after the irradiation. This viscosity variation is called viscosity increase rate (viscosity increase rate=(viscosity of light curable ink to which light has been irradiated—viscosity before the light irradiation)/viscosity before the light irradiation×100(%)), and it is a primary factor in view of obtaining high quality images. As mentioned above, a value of the viscosity increase rate is changed according to light curability of light curable ink, length of irradiation time and light intensity of irradiated light. In other words, with determining viscosity increase rate suitable for forming images, by combining the light curability of light curable ink, the length of irradiation time, the intensity of irradiated light and the like, it is possible to obtain high resolution images.

In order to form a high resolution image at high speed, it is necessary to shorten the time period from the start of light irradiation to the time that the ink getting cured as much as possible. Concretely, in the present embodiment, the light curability is adjusted so that, when the light source 51 irradiates light to light curable ink for 1.0 second, the light curable ink is entirely cured in 1.0 second. Further, in order to form a high resolution image with color bleeding prevented, the light intensity of the light source 51 and the light curability of the light curable ink are adjusted so that the viscosity increase rate of the light curable ink becomes not less than 20% at 0.1 second after the irradiation start. In the present invention, a time period for which the viscosity increase rates becomes not less than 20% is defined as a first predetermined time period, and the first predetermined period is preferably not more than 0.1 second, as mentioned above.

Here, in regard to the adjustment of light intensity of the light source 51, the light intensity has to be changed so as to correspond to the above-mentioned condition. For example, if a light source having unchangeable light intensity is used, light intensity corresponding to the condition is secured by changing an irradiation angle from the light source, placing a shielding plate between the light source and the recording medium P, and/or using a light source having light intensity corresponding to the condition. Further, if a light source having changeable light intensity is used, the same method as the case of using the light source having unchangeable light intensity may be used, or the controller 10 may control the light source so as to make the light intensity correspond to the above-mentioned condition.

On the other hand, in regard to the adjustment of light curability of light curable ink, each component of the light curable ink is adjusted so as to obtain light curability corresponding to the above-mentioned condition.

Further, despite the fact that the light source 51 does not directly irradiate light toward the light curable ink existing at the jetted surface 31 or the jet opening 32, when it is influenced by faint light (leaked light) dispersed from the light source 51, the viscosity thereof increases due to its sensitive light curability. Thereby, there is a possibility of not being able to jet the ink stably. In order to minimize the viscosity increase as much as possible, by irradiating light toward the light curable ink for a second predetermined period which is longer than the first predetermined period, the light having as much light intensity as the leaked light which reaches the jetted surface 31, the light intensity at the jetted surface 31 of the recording head 3 is adjusted so as to make the viscosity increase rate after the irradiation from 5% to 30%. Here, the longer the second predetermined period is, the more the viscosity increase can be minimized, and therefore, preferably the second predetermined period is not less than 10000 seconds.

As the adjustment of light intensity at the jetted surface 31 of the recording head 3, a way of adjusting at least one of a distance I between the light source 51 and the recording head 3, and an irradiation angle of the light source 51, a way of placing a shielding plate between the light source 51 and the recording head 3, and the like can be cited. Here, the distance I between the light source 51 and the recording head 3, that is, an interval of a part where the light source 51 and the recording head 3 are the closest, is preferably set from 1 cm to 10 cm. Thereby, a light emitting part of the light source 51, and the jetted surface 31 and the jet opening 32 of the recording head 3 are arranged with an interval of not less than 1 cm secured between. As a result, it is possible to make a emitting path of the leaked light long, and thereby it is possible to reduce light intensity of the leaked light which reaches the recording head 3.

Next, light curable ink used in the present embodiment will be described. The light curable ink is ink conforming "Photo Curing System using photooxidation, base generating agent (section 1)", "Photoinducing type alternating copolymer (section 2)" in "Photo Curing System (chapter 4)" written in "Photo Curing Technique—selection of resin and initiator, and measurement and evaluation of combination conditions and cure extent (Technique Association Information)" or the like. This light curable ink includes color material, polymerizing type monomer, photoinitiator and the like, and has a property capable of getting cured by monomer's cross-linking, polymerization reaction with the photoinitiator acting as catalyst by receiving light irradiation. However, if ink conforming the above-mentioned "Photoinduced type alternating copolymer (Section 2)" is used, the photoinitiator may be excluded.

Light curable ink, as polymerizable compound, is largely classified into a radical polymerizing type ink including radical polymerizable compound and a cationic polymerizing type ink including cationic polymerizable compound. Here, since the cationic polymerizing type ink having little or no inhibition of polymerization reaction by enzyme is superior in view of functionality and versatility, preferably cationic polymerizing type ink is used.

Light curable ink preferably includes acid multiplication agent which newly generates acid from the acid generated by irradiation of activation light written in Japanese Patent Application Publication (Unexamined). Nos. Tokukai-Hei 8-248561 and Tokukai-Hei 9-34106 and the like. Further, as photo-polymerizable monomer, the light curable ink preferably includes compound comprising at least one kind of oxetane ring. Further, in view of improving coat strength and adhesiveness to a recording medium after the ink is cured, preferably monofunctional oxetane compound including one oxetane ring and multifunctional oxetane compound including at least two oxetane rings are used together. Further, in order to improve light curability, preferably the ink includes compound comprising at least one kind of oxirane ring. Further, vinyl ether compound may be used. In regard to addition amount of the above-mentioned photo-polymerizable monomer, oxetane compound comprising at least one kind of oxetane ring occupies from 50 wt % to 95 wt %, preferably from 60 wt % to 95 wt %, ox irane compound comprising at least one kind of oxirane ring occupies from 5 wt % to 40 wt %, and at least one kine of vinyl ether compound is from 0 wt % to 40 wt %, preferably.

Then, the light curable ink is structured by comprising at least one kind of color material, photooxidation generating agent, photo-polymerizable compound, moisture scavenger and the like.

First, the color material will be described.

As the color material, color materials which are soluble or dispersible into a main ingredient of a polymerizable compound are available. Preferably, a pigment is used in view of antiweatherability. Pigments which can be preferably used in the present invention are cited below:

C.I Pigment Yellow- 1, 3, 12, 13, 14, 17, 81, 83, 87, 95, 109, 42,

C.I Pigment Orange- 16, 36, 38,

C.I Pigment Red- 5, 22, 38, 48:1, 48:2, 48:4, 49:1, 53:1, 57:1, 63:1, 144, 146, 185, 101, C.I Pigment Violet- 19, 23, C.I Pigment Blue- 15:1, 15:3, 15:4, 18, 60, 27, 29, C.I Pigment Green- 7, 36, C.I Pigment White- 6, 18, 21, C.I Pigment Black- 7.

In order to disperse above-described pigments, for example, ball mill, sand mill, attritor mill, roll mill, agitator, Henschel mixer, colloidal mill, ultrasonic homogenizer, pearl mill, wet type jet mill, paint shaker and the like can be used. In addition, dispersing agent can be added when a pigment is subject to be dispersed. It is preferable to use dispersing polymer, and Solsperse series manufactured by Avecia Co. can be given as the dispersing polymer. A variety of synergists according to each pigment are available as dispersing auxiliary. 1 to 50 parts by mass of the dispersing agent and a dispersing auxiliary are preferably added with respect to 100 parts by mass of a pigment. Solvent and polymerizable compound are given as dispersive medium. However light curable ink used in the present invention preferably contains no solvent because the ink should react and cure just after placement of the ink. If the solvent remains in a cured image, degradation of property to solvent resistance, and volatile organic compounds (VOC) of the residual solvent occurs as problems. Therefore, the dispersive medium is not selected from solvent but preferably from polymerizable compound. Among them, monomer having the lowest viscosity is particularly preferable from a viewpoint of dispersing property.

With respect to dispersion of the pigment, the average particle size is preferably set to 0.08 μm to 0.5 μm, and the maximum particle size is set to 0.3 μm to 10 μm, preferably 0.3 μm to 10 μm. Pigments, dispersing agent and dispersing medium are selected and dispersing and filtering condition are set in order to control the particle size. This control of the particle size prevents clogging at the jet opening 32, and keeps conservation stability, and transparency of the ink and sensitivity to curing of the ink. Further, in regard to the light curable ink in the present invention, the concentration of color material is preferably set to 1 wt % to 10 wt % of whole ink.

Next, photo acid generator will be described.

As the photo acid generator, for example, compound utilized in chemical amplification type photoresist or photo cationic polymerization is used ("Organic Materials for imaging" by The Japanese Research Association for Organic Electronics Materials; Bunshin Publishing (1993), see page 187–192). Compound examples suitable for the present invention are cited below. First, $B(C_6F_5)_4^-$, $PF_6^-$, $AsF_6^-$, $SbF_6^-$, $CF_3SO_3^-$ salt of aromatic onium compound such as diazonium, ammonium, iodonium, sulfonium, phosphonium and the like can be cited. Photo acid generator having borate as anti-anion is preferably used since it has high acid generating ability. Concrete examples of onium compound are shown below.

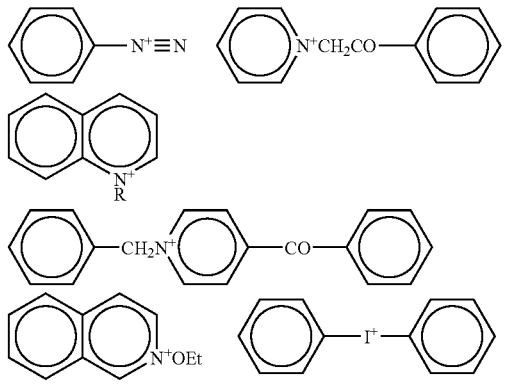

-continued
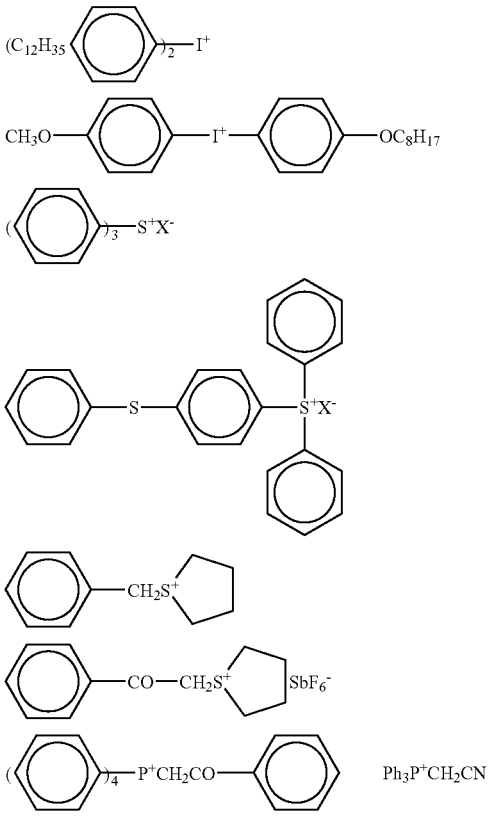
Second, sulfone compound generating sulfonic acid can be cited. Concrete examples of the sulfone compound are shown below.
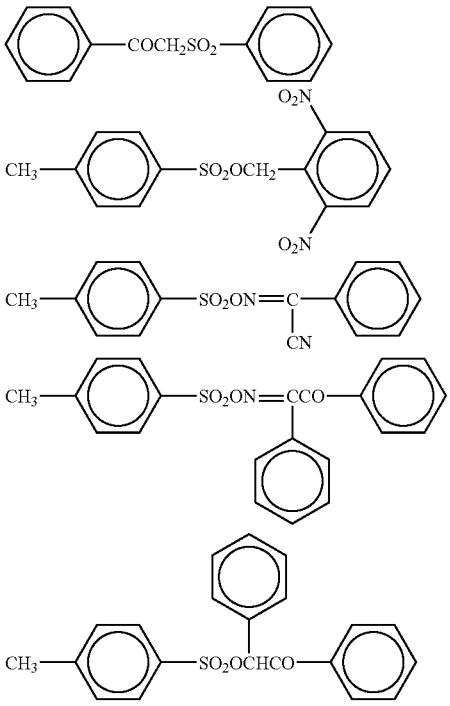
-continued
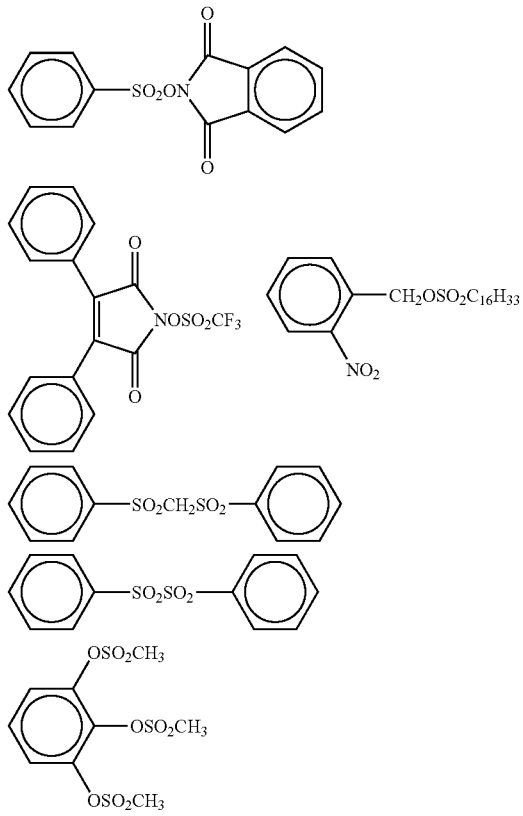
Third, halogen compound generating hydrogen halide can be used. Concrete examples of the halogen compound are shown below.
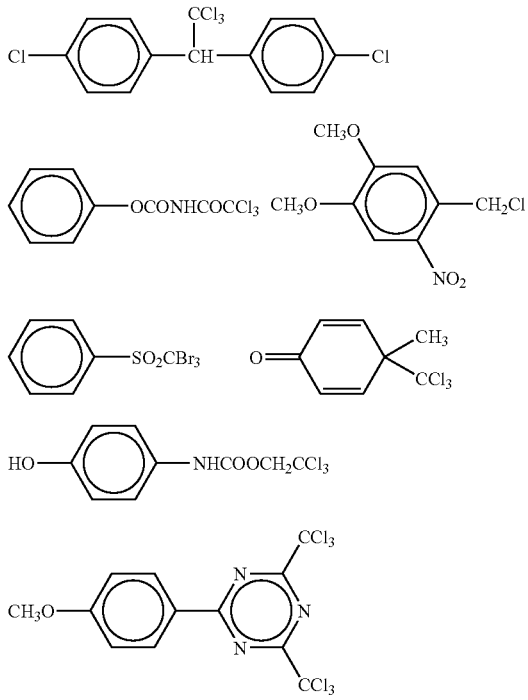

Fourth, iron allene complex can be used. Concrete examples of the iron allene complex are shown below.

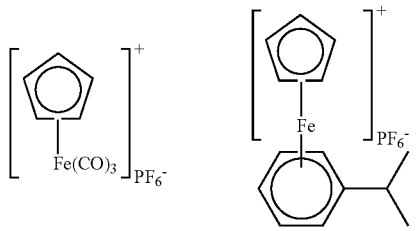

The light curable ink in the present invention preferably includes acid multiplication agent which newly generates acid from the acid generated by irradiation of activation light, which has already been known in Japanese Patent Application Publication (Unexamined) Nos. Tokukai-Hei 8-248561, Tokukai-Hei 90034106 and others. With the use of acid multiplication agent, it is possible to improve jetting stability even more.

Further, preferably light curable ink in the present invention includes at least one kind of photo acid generator selected among aromatic onium compound of diazonium, iodnium or sulfonium having aryl borate as anti-ion, iron allene complex.

Next, light polymerizing type compound according to the present invention will be described.

First, cationic polymerizing type compound as the light polymerizing type compound will be described. As the cationic polymerizing type compound, various kinds of known cationic polymerizing type monomer can be used. For example, epoxy compound, vinyl ether compound, oxetane compound and the like illustrated in Japanese Patent Application Publication Nos. Tokukai-hei 6-9714, Tokukai 2001-31892, Tokukai 2001-40068, Tokukai 2001-55507, Tokukai 2001-310938, Tokukai 2001-310937 and Tokukai 2001-220526 can be cited.

As the epoxy compound, for example, aromatic epoxide, alicyclic epoxide, aliphatic epoxide and the like can be used.

Preferably, as aromatic epoxidem, diglycidylether or polyglycidylether produced by reaction between polyhydric phenol including at least one aromatic nucleus or its alkyleneoxide adduct and epichlorohydrin, for example, Bisphenol-A (BPA) or its alkyleneoxide adduct, diglycidylether or polyglycidylether, hydrogenated Bisphenol-A or its alkyleneoxide adduct, diglycidylether or polyglycidylether, novolac-type epoxy resin and the like can be cited. Here, as alkyleneoxide, ethyleneoxide, propyleneoxide and the like can be cited.

As alicyclic epoxide, preferably, a compound including cyclohexeneoxide or cyclopenteneoxide obtained by epoxidazing a compound including at least one cyclohexene or cycloalkane ring such as cyclopentene ring with hydrogen proxide, peroxy acid and the like is used.

Alicyclic epoxide is, preferably, aliphatic polyalcohol or its alkyleneoxide adduct, diglycidylether or polyglycidylether or the like. As its typical example, diglycidylether of polyalkyleneglycol such as diglycidylether of alkyleneglycol such as diglycidylether of ethyleneglycol, diglycidylether of propyleneglycol, diglycidylether of 1,6-hexanediol and the like, polyglycidylether of polyalcohol such as diglycidylether or triglycidylether of glycerin or its alkyleneoxide adduct and the like, diglycicylether of polyethyleneglycol or its alkyleneoxide adduct, diglycidylether of polypropyleneglycol or its alkyleneoxide adduct, and so forth can be cited. Here, as alkyleneoxide, ethyleneoxide, propyleneoxide and the like can be cited.

Among these epoxy compounds, in view of rapid light curability, preferably aromatic epoxide and alicyclic epoxide and the like are used. In particular, alicyclic exposide is used. In the present invention, one kind of the above-mentioned epoxides may be used singularly, or two or more kinds thereof may be used in suitable combination.

As vinylether compound, for example, divinylether compound or trivinylether compound such as ethyleneglycoldivinylether, diethyleneglycoldivinylether, triethyleneglycoldivinylether, propyleneglycoldivinylether, dipropyleneglycoldivinylether, butanedioldivinylether, hexanedioldivinylether, cyclohexanedimethanoldivinylether, trimethylolpropanetrivinylether and the like, monovinylether compound such as ethylvinylether, n-butylvinylether, isobutylvinylether, octadecylvinylether, cyclohexylvinylether, hydroxybutylvinylether, 2-ethylhexylvinylether, cyclohexanedimethanolmonovinylether, n-propylvinylether, isopropylvinylether, isopropenylether-O-propylenecarbonate, dodecylvinylether, diethyleneglycolmonovinylether, octadecylvinylether and the like, can be cited.

Among these vinyl ether compound, in view of light curability, adhesiveness and surface hardness, preferably the divinylether compound or the trivinylether compound is used, in particular, the divinylether compound is used. In the present invention, one kind of the above-mentioned vinylether compounds may be used singularly, or two or more kinds thereof may be used in suitable combination.

An oxetane compound is compound including an oxetane ring, and any known oxetane ring such as ones disclosed in Japanese Patent Application Publication (Unexamined) No. Tokukai 2001-220526 and No. Tokukai 2001-310937 can be used. If a compound including five or more oxetane rings is used, viscosity of the composition becomes high, and it makes handling difficult, and makes viscosity of obtained cured material insufficient due to high glass-transition temperature of the composition. A compound including an oxetane ring to be used in the present invention, preferably includes a compound including one to four oxetane ring(s).

As a compound including one oxetane ring, for example a compound shown as a general formula (1) below or the like can be cited.

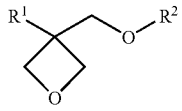

(1)

In the formula (1), $R^1$ is hydrogen atom, alkyl group having carbon number of one to six, such as methyl group, ethyl group, propyl group, butyl group or the like, fluoroalkyl group having carbon number of one to six, aryl group, furyl group or thienyl group. $R^2$ is alkyl group having carbon number of one to six, such as methyl group, ethyl group, propyl group, butyl group or the like, alkenyl group having carbon number of two to six, such as 1-propenyl group, 2-propenyl group, 2-methyl-1-propenyl group, 2-methyl-2-propenyl group, 1-butenyl group, 2-butenyl group, 3-butenyl group or the like, group including an aromatic ring such as phenyl group, benzyl group, fluorobenzyl group, methoxybenzyl group, phenoxyethyl group or the like, alkylcarbonyl group having carbon number of two to six such as ethylcarbonyl group, propylcarbonyl group, butylcarbonyl group or the like, alkoxycarbonyl group having carbon number of two to six such as ethoxycarbonyl group, propoxycarbonyl group, butoxycarbonyl group or the like, N-alkylcarbamoyl group having carbon number of two to six such as ethylcarbamoyl group, propylcarbamoyl group, butylcarbamoyl group or the like. As the oxetane compound used in the present invention, it is particularly preferable to use compound including one oxetane ring since the composition to be obtained has superior viscosity, that is, the composition has low viscosity so that operationality is superior.

Next, as a compound including two oxetane rings, compound shown as a general formula (2) below or the like can be cited.

(2)

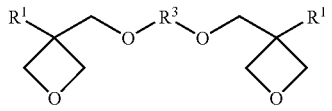

In the formula (2), $R^1$ is approximately the same group as that of the general formula (1). $R^3$ is linear or branched alkylene group such as ethylene group, propylene group or the like, linear or branched poly (alkyleneoxy) group such as poly (ethyleneoxy) group, poly (propyleneoxy) group and the like, linear or branched unsaturated carbon-hydrogen group such as propenylene group, methyl propenylene group or the like, carbonyl group, alkylene group including carbonyl group, alkylene group including carboxyl group, alkylene group including carbamoyl group or the like. Further, $R^3$ is also polyad selected among formulae (3) (4) and (5) shown below.

(3)

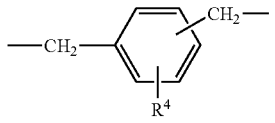

In the formula (3), $R^4$ is hydrogen atom, alkyl group having carbon number of one to four, such as methyl group, ethyl group, propyl group, butyl group or the like, alkoxy group having carbon number of one to four, such as methoxy group, ethoxy group, propoxy group, butoxy group or the like, halogen atom such as chlorine atom, bromine atom or the like, nitro group, cyano group, mercapto group, lower alkylcarboxyl group, carboxyl group, or carbamoyl group.

(4)

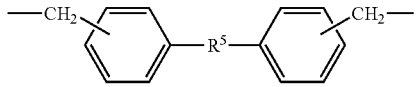

In the formula (4), $R^5$ is oxygen atom, sulfur atom, methylene group, NH, SO, $SO_2$ $C(CF_3)_2$, or $C(CH_3)_2$.

(5)

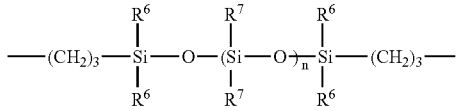

In the formula (5), $R^6$ is alkyl group having carbon number of one to four, such as methyl group, ethyl group, propyl group, butyl group or the like, or aryl group. "n" is an integer from 0 to 2000. $R^7$ is alkyl group having carbon number of one to four, such as methyl group, ethyl group, propyl group, butyl group or the like or aryl group. Further, $R^7$ is also a group selected among groups shown as formula (6) below.

(6)

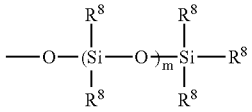

In the formula (6), $R^8$ is alkyl group having carbon number of one to four, such as methyl group, ethyl group, propyl group, butyl group or the like or aryl group. "m" is an integer from 0 to 100. As a concrete example of compound including two oxetane rings, compound shown as formulae (7) and (8) below or the like can be cited.

(7)

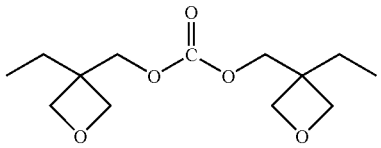

The compound shown as the formula (7) is compound of the formula (2) where $R^1$ is ethyl group and $R^3$ is carboxyl group.

(8)

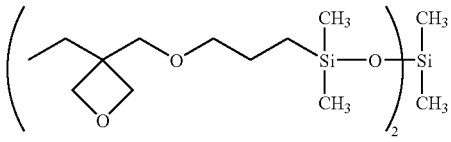

The compound shown as the formula (8) is compound of the general formula (2) where $R^1$ is ethyl group, $R^3$ is the one shown as the formula (5) where $R^6$ and $R^7$ are methyl group and "n" is 1.

In regard to compound including two oxetane rings, as a preferable example other than the above-mentioned compound, compound shown in a general formula (9) below can be cited. In the formula (9), $R^1$ is approximately the same as that of the above-mentioned general formula (1).

(9)

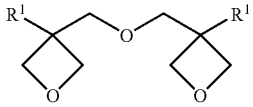

As compound including three or four oxetane rings, a compound shown as a general formula (10) below or the like can be cited.

(10)

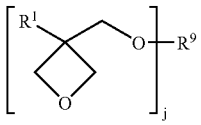

In the formula (10), $R^1$ is approximately the same group as that of the above-mentioned general formula (1). $R^9$ is branched alkylene group having carbon number of 1 to twelve, such as groups shown as formulae (11) to (13) below or the like, branched poly (alkyleneoxy) group such as group shown as a formula (14) below or the like, branched polysiloxy group such as group shown as a formula (15) below or the like, and so forth. "j" is 3 or 4.

(11)

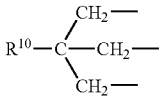

In the formula (11), $R^{10}$ is lower alkyl group such as methyl group, ethyl group, propyl group or the like.

(12)

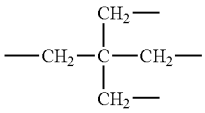

(13)

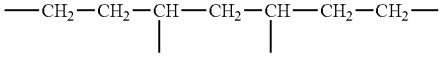

(14)

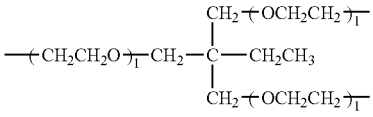

In the formula (14), "1" is an integer from 1 to 10.

(15)

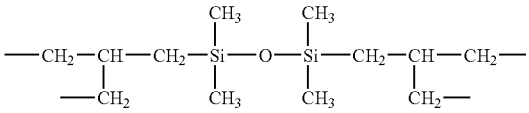

As a concrete example of compound including three to four oxetane rings, for example, compound shown as a formula (16) below or the like can be cited.

(16)

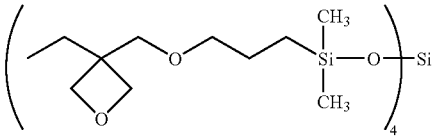

Further, as an example of compound including one to four oxetane ring(s) other than the above-mentioned examples, compound shown as a formula (17) below can be cited.

(17)

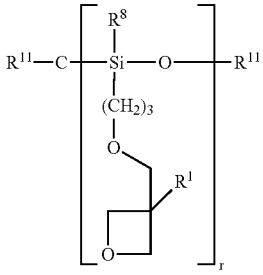

In the formula (17), $R^8$ is approximately the same group as that of the formula (6). R11 is alkyl group having carbon number of one to four, such as methyl group, ethyl group, propyl group, butyl group or the like, or trialkylsilyl group, and "r" is from 1 to 4. As a preferable concrete example of oxetane compound used in the present invention, compound shown below can be cited.

(18)

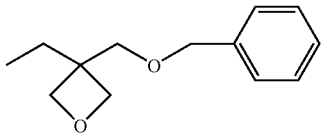

(19)

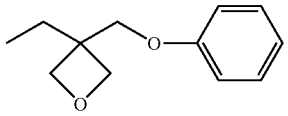

(20)

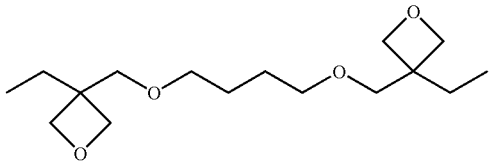

A production method of the above-mentioned compound including oxetane ring(s) is not in particular limited, and it may follow a conventionally known method. For example, an oxetane synthetic method from diol disclosed in Pattison (D. B. Pattison, J. Am. Chem. Soc., 3455, 79(1957)) can be cited. In addition, other than them, compound including one to four oxetane ring(s) having large molecular weight, that is, molecular weight of 1000 to 5000, approximately, can be cited. As an example of them, for example, compound shown below can be cited.

(21)

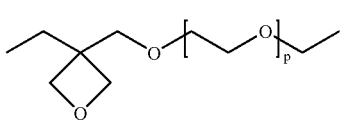

Here, "p" is from 20 to 200.

(22)

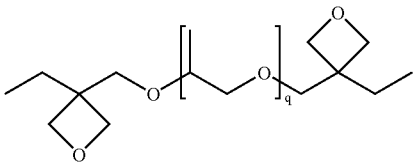

Here, "q" is from 15 to 100.

(23)

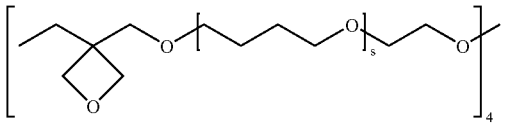

Here, "s" is from 20 to 200.

By the way, in the present invention, for the purpose of restraining contraction of the recording medium P at the time of curing ink, preferably a photo-polymerizable compound includes at least one kind of compound selected among at least one kind of oxetane compound, epoxy compound and vinylether compound.

Next, as the photo-polymerizable compound, a radical polymerizable compound will be described.

The radical polymerizable compound is compound including ethyleny unsaturated bond capable of radical polymerization, and as long as a molecule includes at least one ethyleny unsaturated bond capable of radical polymerization, it may be in any form, and it includes a chemical form such as monomer, polymer and the like. Only one kind of radical polymerizable compound may be used, or, in order to improve a purposed property, two or more kinds thereof may be used at any ratio.

As an example of compound including ethyleny unsaturated bond capable of radical polymerization, radical polymerizable compound such as unsaturated carboxylic acid such as acrylic acid, methacrylic acid, itaconic acid, crotonic acid, isocrotonic acid, maleic acid or the like and its salt, ester, urethane, amido and anhydrite; acrylonitorile; styrene; further various types of unsaturated polyester; unsaturated polyether; unsaturated polyamide; unsaturated urethane or the like, can be cited. Concretely, acrylic acid derivative such as 2-ethylhexylacrylate, 2-hydroxyethylacrylate, butoxyethylacrylate, carbitolacrylate, cyclohexylacrylate, tetrahydrofurfurylacrylate, benzylacrylate, bis (4-acryloxypolyethoxyphenyl) propane, neopentylglycoldiacrylate, 1,6-hexanedioldiacrylate, ethyleneglycoldiacrylate, diethyleneglycoldiacrylate, triethyleneglycoldiacrylate, tetraethyleneglycoldiacrylate, polyethyleneglycoldiacrylate, polypropyleneglycoldiacrylate, pentaerythritoltriacrylate, pentaerythritoltetraacrylate, dipentaerythritoltetraacrylate, trimethylolpropanetriacrylate, tetramethylolmethanetetraacrylate, oligoesteracrylate, N-methylolacrylamide, diacetoneacrylamide, epoxyacrylate or the like, methacrylic acid derivative such as methylmethacrylate, butylmethacrylate, 2-ethylhexylmethacrylate, lauryl methacrylate, allylmethacrylate, glycidylmethacrylate, benzylmethacrylate, dimethylaminoethylmethacrylate, 1,6-hexanedioldimethacrylate, ethyleneglycoldimethacrylate, triethyleneglycoldimethacrylate, polyethyleneglycoldimethacrylate, polypropyleneglycoldimethacrylate, trimethylolethane trimethacrylate, trimethylolpropane trimethacrylate, 2,2-bis (4-methacryloxypolyethoxyphenyl) propane, or the like, and so forth, allyl compound such as allylglycidylether, diallylphthalate, triallyltrimellitate, or the like, can be cited. Even more concretely, commercially available or well known in the industry, radical polimerizable or cross-linkable monomer, oligomer and polymer disclosed in "Cross-linking Agent Handbook" written by Shinzo Yamashita (1981, Taiseisha); "UV, EB Curing Handbook (ingredient part)" written by Kiyoshi Kato (1985, Koubunshikankoukai); P. 97 in "Application and Market of UV, EB curing technique" written by RadTech Japan (1989, CMC); "Polyester Resin Handbook" written by Eiichiro Takiyama (1988, The Nikkan Kogyo Shinbun, Ltd.) or the like, can be used.

Addition amount of the above-mentioned radical polymerizable compound to ink is preferably 1 to 97 wt %, more preferably 30 to 95 wt %.

As radical polymerization initiator, triazine disclosed in Japanese Patent Application Publication (Examined) Nos. Tokuko-Syo 59-1281 and 61-9621, Japanese Patent Application Publication (Unexamined) No. Tokukai-Syo 60-60104 and the like; organic peroxyacid disclosed in Japanese Patent Application Publication (Unexamined) Nos. Tokukai-Syo 59-1504, 61-243807 and the like; diazonium compound disclosed in Japanese Patent Application Publication (Examined) Nos. Tokuko-Syo 43-23684, 44-6413, 44-6413 and 47-1604, and U.S. Pat. No. 3,567,453 and the like; organic azido compound disclosed in U.S. Pat. No. 2,848,328, U.S. Pat. No. 2,852,379, and U.S. Pat. No. 2,940,853, ortho-quinone diazide series disclosed in Japanese Patent Application Publication (Examined) Nos. Tokuko-Syo 36-22062, 37-13109, 38-18015, 45-9610 and the like, various types of onium compound disclosed in Japanese Patent Application Publication (Examined) No. Tokuko-Syo 55-39162, Japanese Patent Application Publication (Unexamined) No. Tokukai-Syo 59-14023 and P. 1307, Vol. 10 of "Macromolecules" (1977), azo compound disclosed in Japanese Patent Application Publication No. Tokukai-Syo 59-142205, metal allene complex disclosed in Japanese Patent Application Publication (Unexamined) No. Tokukai-Hei 1-54440, European Patent Publication 109, 851, European Patent Publication 126,712, and P. 174m Vol. 30 of "Journal of Imaging Science" written by J. Imag. Sci (1986), (oxo) sulfonium organic boron complex disclosed in Japanese Patent Application Publication (Unexamined) Nos. Tokukai-Hei 5-213861, 5-255347, titanocene class disclosed in Japanese Patent Application Publication (Unexamined) No. Tokukai-Syo 61-151197, transition metal complex including transition metal such as ruthenium or the like disclosed in P. 85-277, Vol. 84 of "Coordination Chemistry Review" (1988) and Japanese Patent Application Publication (Unexamined) No. Tokukai-Hei 2-182701, 2,4,5-triarylimidazole dimer, carbon tetrabromide disclosed in Japanese Patent Application Publication (Unexamined) No. Tokukai-Hei 3-209477, organic halogen compound disclosed in Japanese Patent Application Publication (Unexamined) No. Tokukai-Syo 59-107344, and so forth, can be cited.

These polymerization initiators are included preferably at a range of 0.01 to 10 mass ratio with respect to compound including ethyleny unsaturated bond capable of radical polymerization as 100 mass ratio.

Next, moisture scavenger will be described.

As moisture scavenger, compound including hydrolyzable group and/or compound including isocyanate group can be used. As a concrete example of the compound including hydrolyzable group, trialkylester orthoformate series such as triethyl orthoformate or the like, trialkylester orthoacetic acid series such as trimethyl orthoacetic acid or the like, trialkylester orthoboric acid series such as tributyl orthoboric acid or the like, and an element of silicate series shown as a formula (24) below can be cited.

$$Si(R^{12})_{4-p-q}(OR^{13})_p(R^{14})_q \quad (24)$$

In the formula, $R^{12}$ is hydrogen atom, alkyl group, phenyl group, benzyl group or vinyl group, $R^{13}$ is alkyl group, phenyl group, benzyl group, vinyl group, isopropenyl group acetyl group or benzoyl group, $R^{14}$ is alkyl group or y-glycidoxypropyl group, "p" is an integer from 1 to 4, and "q" is 0 if "p" is 4, and "q" is 0 or 1 if "p" is an integer of 1 to 3.

Among these moisture scavengers, preferably compound which does not generate alcohol component when scavenging moisture is used. As a concrete example, isopropenoxytrimethylsilane, γ-glycidoxypropylmethyldiisopropenoxysilane, methyltriisopropenoxysilane, tetraacetoxysilane, and further, compound including isocyanate group, for example, isocyanate compound such as phenylisocyanate and the like can be cited. These moisture scavengers can be used singularly or in combination.

Here, using amount of the moisture scavenger is 0.01 wt % to 40 wt % with respect to total ink amount as 100 wt %, preferably 0.1 wt % to 30 wt %, particularly preferably 0.5 wt % to 20 wt %. The reason to limit the using amount of the moisture scavenger in this way is because it is not possible to achieve effects of the present invention if it is less than 0.01 wt %, and because color impurity is caused if it is more than 40 wt %. It is known to use a moisture scavenger in coating material for vehicle outer plates, and the present inventor has discovered that it is possible to improve bleeding of ink in the inkjet type by using these moisture scavengers. Therefore, if light curable ink having the above-mentioned structure is used, it is possible to drastically improve stability of ink jetting and to form a high-resolution image with good reproducibility.

To the light curable ink in regard to the present invention, it is possible to apply various types of addition agents other than the above-mentioned ones. For example, in order to enhance maintainability of ink composition, it is possible to add polymerization inhibitor at 200 ppm to 20000 ppm. Since the light curable ink is jetted with being heated and made lowly viscous, preferably polymerization inhibitor is added also for preventing head clogging due to thermal polymerization. Further, according to need, surfactant, leveling addition agent, matte agent, polyester resin for adjusting membrane property, polyurethane resin, vinyl resin, acrylic resin, rubber resin, wax class and the like can be added. In order to improve adhesiveness to the recording medium P, it is effective to add ultralow volume of organic solvent. In this case, its using amount is within the range from 0.1 wt % to 5 wt %, preferably 0.1 wt % to 3 wt %. Further, radical-cation hybrid-type curable ink can be used by combining radical polymerizable monomer and initiator.

Further, the light curable ink preferably has viscosity at 25° C. being 7 mPa·s to 50 mPa·s for stabilizing the jetting and obtaining fine light curability regardless of environment such as ambient temperature, humidity and the like.

Next, the recording medium P used in the present embodiment will be described.

To the recording medium P, it is possible to apply recording medium made of various types of paper such as regular paper, recycled paper, glossy paper and the like, various types of textile, various types of nonwoven fabric, resin, metal, glass and the like. Further, as a form of the recording medium P, preferably a roll form, cut-sheet form plate form and the like are applicable. In particular, as the recording medium P used in the present embodiment, transparent or translucent unabsorbent resin film used for soft-packaging is used. As a concrete resin kind of the resin film, polyethyleneterephthalate, polyester, polyolefin, polyamide, polyesteramide, polyether, polyimide, polyamideimide, polystylene, polycarbonate, poly-ρ-phenylane sulfide, polyetherester, polyvinylchloride, poly(metha)acrylic ester, polyethylene, polypropylene, nylon and the like are applicable. Further, copolymer of these resins, mixture of these resins, cross-linked component of these resins are also applicable. In particular, as a resin kind of the resin film, selecting one of drawn polyethyleneterephthalate, polysthylene, polypropylene, nylon is preferable in view of transparency of resin film, dimensional stability, rigidity, environmental load, cost and the like. The resin film having thickness of 2 μm to 100 μm (more preferably 6 μm to 50 μm) is preferably used. Further, surface processing such as corona discharge treatment, easy adhesion processing and the like may be applied to the surface of a support medium of the resin film. Further, as the recording medium P used in the present embodiment, known opaque recording medium such as various types of paper having surface coated with resin, film including pigment, foamed film and the like is applicable.

Next, an image recording method executed by the above-mentioned image recording device 1 will be described.

The controller 10 controls a driving force 11 to intermittently convey the recording medium P in a conveyance direction A with a conveyance device. When the conveyance of the recording medium P is in a halted state, the controller 10 controls a carriage driving force 41 to make a carriage 4 scan along a scanning direction B. At this scanning, the controller 10 controls a recording head 3 and a light source 51 to jet light curable ink on the recording medium P and irradiate light toward the recording medium P from the light source 51, respectively, to cure the light curable ink on the recording medium P. By repeating the process, an image is formed on the recording medium P.

Here, from the time that the maintenance is once performed until the second predetermined time period has passed, it is possible to jet light curable ink stably, but after the second predetermined time period has passed, since there is a possibility of curing the light curable ink existing at the jetted surface 31 and the jet opening 32. Therefore, next maintenance is performed before the second predetermined time period has passed.

Next, operation at the time of maintenance will be described.

When the maintenance timing comes, the controller 10 controls the carriage driving force 41 to move the carriage to the maintenance area 22 so as to make the recording head 3 and the cap members 61 face each other. After that, the controller 10 controls the maintenance driving force 63 to raise the maintenance unit 6 so as to make the cap members 61 adhere to the jetted surface 31 of the recording head 3. At this time, the air communicating valve 68 is in a closed state.

When the cap members 61 adhere the jetted surface 31, the controller 10 controls the absorbing pump 65 so as to make inside of the cap members 61 negative-pressured in order to absorb the light curable ink into the jet opening 32. With this absorption, the light curable ink removed from the jet opening 32 is absorbed into absorber and then brought to the deteriorated ink tank 66. When the absorption is completed, the controller 10 controls the air communicating valve 68 so as to make the air communicating valve 68 in an opened state and then controls the maintenance driving force 63 to lower the maintenance unit 6. Thereafter, the controller 10 controls the maintenance driving force 63 to move the maintenance unit 6 so as to make the blades 62 wipe the jetted surface 31. In response to the completion of the wipe, the controller 10 controls the maintenance driving force 63 to move the maintenance unit 6 so as to make the cap members 61 and the jetted surface 31 face each other. In this way, when the cap members 61 and the jetted surface 31 face each other after the wipe, the controller 10 controls the recording head 3 to perform the dummy jetting. With the dummy jetting performed, meniscus is formed in the jet opening 32 and then the maintenance is completed.

As mentioned, according to the image recording device 1 in the present embodiment, when light having light intensity at the jet opening 31 of the recording head 3, that is, light corresponding to the leaked light is irradiated toward the light curable ink for the second predetermined time period, since the light intensity at the jetted surface 31 of the recording head 3 is adjusted so as to increase the viscosity of the light curable ink within the range from 5% to 30%, after the second predetermined time period has passed, the light curable ink is not entirely cured despite the fact that the viscosity of the light curable ink has increased within the range from 5% to 30%, and thereby it is possible to perform maintenance at least within the second predetermined time period. Therefore, if the second predetermined time period can be set to as long a time period as possible, even in the case of using light curable ink of cationic polymerizing type, it is possible to minimize the increase of maintenance frequency and thereby high-speed image formation can be achieved.

Here, the present invention is not limited to the above-mentioned embodiment, and various types of modification and alteration of the design may be made without departing the gist of the present invention.

For example, in the present embodiment, the description is made by illustrating an inkjet printer of a serial type. In addition, an inkjet printer of line system is also applicable. A concrete example where the present invention is applied to the inkjet printer of line system will be described with reference to FIGS. 4 to 6. Here, identical numeral is added to a portion having the same function as the above-mentioned embodiment and the description of the portion is omitted.

Figure 4:
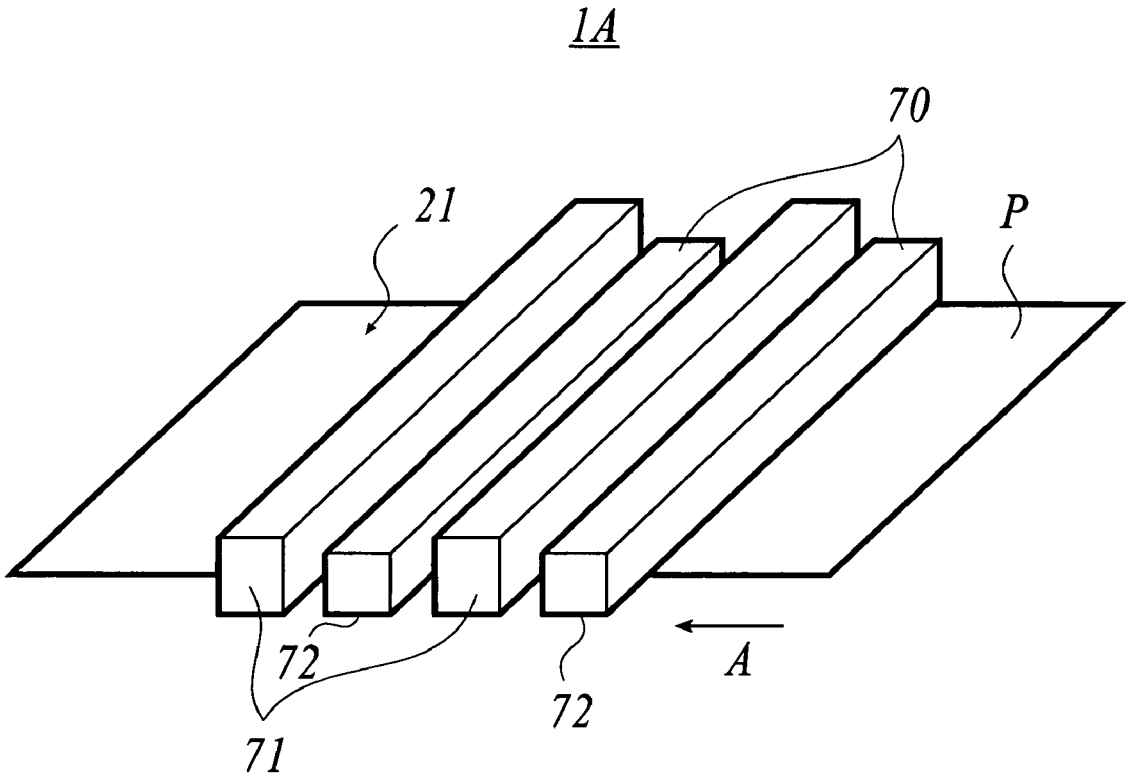
FIG. 4 is a perspective view showing an alternative of the image recording device of FIG. 1, FIGS. 5A and 5B are perspective views showing a maintenance processing unit included in the image recording device of FIG. 4, and FIGS. 6A and 6B are side views showing the maintenance processing unit of FIGS. 5A and 5B.

As shown in FIG. 4, an image recording device 1A is an inkjet printer of line system. In the image recording device 1A, a plurality of recording heads 70 extending in a direction orthogonal to the conveyance direction A of the recording medium P are provided, and each recording head 70 is arranged along the conveyance direction A of the recording medium P. At a downstream side of each recording head 70 in the conveyance direction A, a light irradiation device 71 is provided.

On a jetted surface 72 of the recording head 70, the jetted surface 72 facing the recording medium P, a plurality of jet openings (illustration omitted) for jetting ink are provided along the direction orthogonal to the conveyance direction A.

Further, a maintenance processing unit 9 is provided at outside of a forming area 21 to form an image on the recording medium P, and is capable of moving in the direction orthogonal to the conveyance direction of the recording medium P by a driving unit (not shown). Further, one edge part of the forming area 21 is defined as an evacuation area (not shown) for evacuating the maintenance processing unit 9 when it is not used.

As shown in FIGS. 5A to 6B, movable rails 91 having longer size than the recording head 70 are provided with the same number as the recording head 70 so as to correspond to the recording head 70. Further, above the movable rails 91, a wipe roller. 92 is provided so as to be capable of moving back and forth over the movable rail 91 by a motor 93. Above the movable rail 91, a long wipe member 94 having both ends thereof wound as roll-like are provided, and at one edge of one of the rolls, a motor 95 for winding the wipe member 94 is provided. Here, as the wipe member 94, used is nonwoven fabric into which solvent is absorbed, the solvent for cleansing the jetted surface 72 of the recording head 70.

Next, a maintenance operation of the image recording device 1A will be described.

Figure 5A:
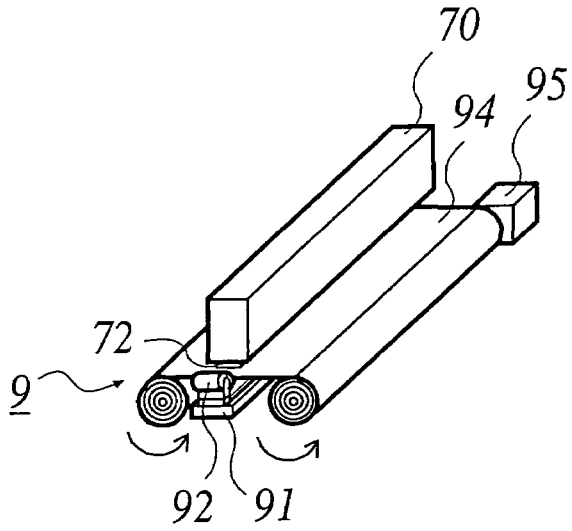
Figure 5B:
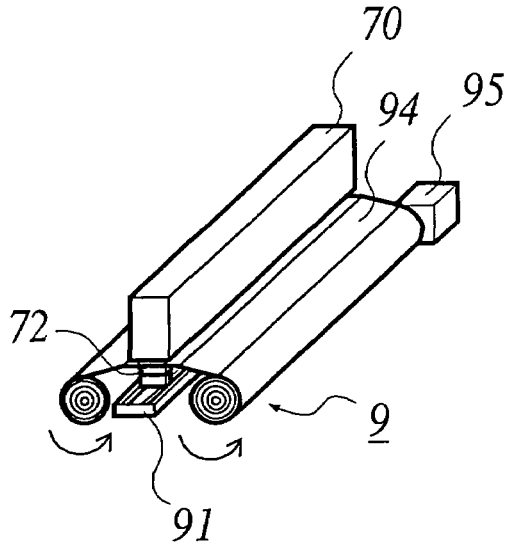
Figure 6A:
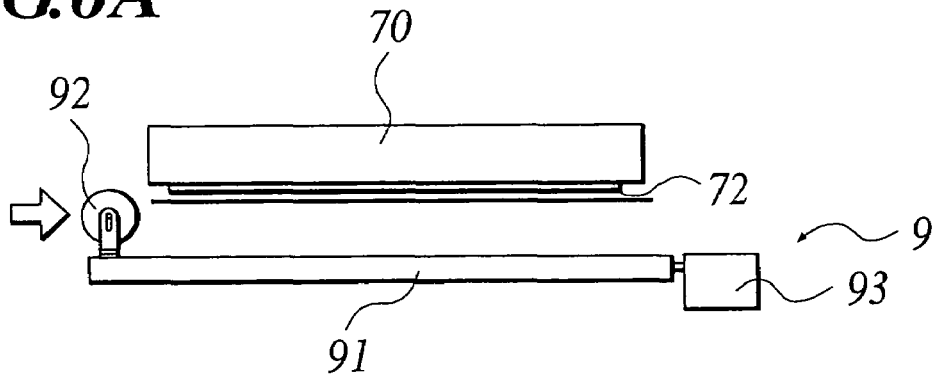
Figure 6B:
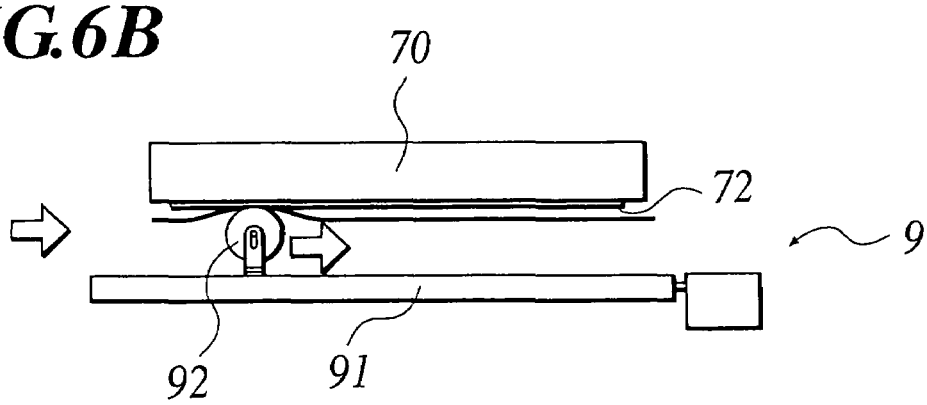

At the beginning of the maintenance, the recording medium P is lowered so as to secure space between the recording head 70 and the recording medium P, the space into which the maintenance processing unit 9 can be inserted. Thereafter, as shown in FIGS. 5A and 6A, the maintenance processing unit 9 being in the evacuation area is moved to a position facing the jetted surface 72 of the recording head 70. When the maintenance processing unit 9 reaches the predetermined position, as shown in FIG. 5B and 6B, the motor 93 moves the wipe roller 92 from one edge to another edge of the recording head 70 over the movable rail 91. At this time, since the wipe roller 92 makes the wipe member 94 pressed on the jetted surface 72 of the recording head 70, ink adhering on the jetted surface 72 is wiped away by the wipe member 94. Thereafter, if the-wipe member 94 gets stained, the motor 95 winds the stained part of the wipe member 94 to bring a clean part available.

EXPERIMENTAL EXAMPLE

Hereinafter, the present invention will be described with experimental examples illustrated. However, the present invention is not limited to the description below.

In this experimental example, as ink of each color, yellow (Y), magenta (M), cyan (C), black (K) and white (W), used was cationic polymerizing type ink obtained by blending each composition at a ratio written in TABLE 1.

TABLE 1

| | | K | C | M | Y | W |
|---|---|---|---|---|---|---|
| COLOR MATERIAL | | 1 | 2 | 3 | 4 | 5 |
| ADDITION AMOUNT (WT %) | | 4 | 3 | 4 | 3 | 20 |
| OXETANE | OXT221 | 66.995 | 62.995 | 66.995 | 67.995 | 45.995 |
| ACID MULTIPLICATION AGENT | COMPOUND 1 | 1 | 1 | 1 | 1 | 1 |
| EPOXY COMPOUND | EPOXY COMPOUND F (EPOXIDIZED SOYBEAN OIL) | 20 | 20 | 20 | 20 | 20 |
| THERMAL BASE GENERATOR | THERMAL BASE GENERATOR 1 | 2 | 2 | 2 | 2 | 2 |

TABLE 1-continued

| | | K | C | M | Y | W |
|---|---|---|---|---|---|---|
| PHOTO ACID GENERATOR | CS5102 (NIPPON SODA CO., LTD) | 5 | 10 | 5 | 5 | 10 |
| INITIATOR AUXILIARY AGENT | CI7001 (NIPPON SODA CO., LTD) | 1 | 1 | 1 | 1 | 1 |
| FLUORINATED NONIONIC SURFACTANT | PRODUCT NAME: MEGAFACE F-178K BY DAINIPPON INK AND CHEMICALS, INCORPORATED | 0.005 | 0.005 | 0.005 | 0.005 | 0.005 |

Here, the detail in TABLE 1 is written below.

Color Material 1: C. I. Pigment Black-7

Color Material 2: C. I. Pigment Blue-15:3

Color Material 3: C. I. Pigment Red-57:1

Color Material 4: C. I. Pigment Yellow-13

Color Material 5: titanium oxide (Atanase type; average particle diameter 0.20 μm)

Thermal base generator 1 and compound 1 are shown below:

COMPOUND 1

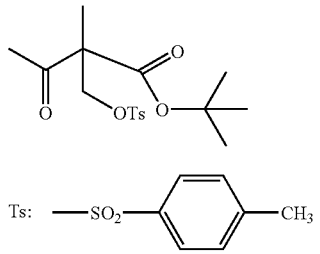

-continued

THERMAL BASE GENERATOR 1

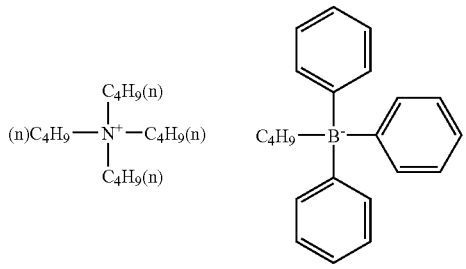

As the recording medium P, oriented polypropylene (OPP), polyethylene terephthalate (PET), quality paper were used by being formed as width of 600 nm and length of 1000 nm, respectively.

As the light source 51, a fluorescent lamp (custom made by Nippo CO.,LTD.; electric source power consumption not more than 1 kW/hour), and a 120 w/cm metal halide lamp (made by Japan Storage Battery CO.,LTD.; 3 kWhr power source: shown as * in TABLE) were used.

Then, with a distance between the jetted surface 31 of the recording head 3 and the light source 51 set to 0.5 cm, 1 cm, 5 cm and 15 cm, and with the combination of the light source 51 and the recording medium P written in TABLE 2, an image was formed and comparative examples 1 to 6 and experimental examples 1 to 9 were obtained.

TABLE 2

| | RECORDING MEDIUM | LIGHT SOURCE | MAXIMUM IRRADIATION INTENSITY | DISTANCE FROM HEAD TO LIGHT SOURCE (cm) | VISCOSITY INCREASE RATE IN 0.1 SECOND | VISCOSITY INCREASE RATE IN 10000 SECONDS WITH LEAKED LIGHT |
|---|---|---|---|---|---|---|
| COMPARATIVE EXAMPLE 1 | OPP | * | 1000 mW/cm2 | 0.5 | CURED | 50 |
| COMPARATIVE EXAMPLE 2 | PET | * | 1000 mW/cm2 | 0.5 | CURED | 50 |
| COMPARATIVE EXAMPLE 3 | QUALITY PAPER | * | 1000 mW/cm2 | 0.5 | CURED | 40 |
| COMPARATIVE EXAMPLE 4 | OPP | FLUORESCENT LAMP | 3 mW/cm2 | 1 | 5 | 2 |
| COMPARATIVE EXAMPLE 5 | PET | FLUORESCENT LAMP | 3 mW/cm2 | 1 | 5 | 2 |
| COMPARATIVE EXAMPLE 6 | QUALITY PAPER | FLUORESCENT LAMP | 3 mW/cm2 | 1 | 5 | 1 |
| EXPERIMENTAL EXAMPLE 1 | OPP | * | 1000 mW/cm2 | 15 | CURED | 10 |
| EXPERIMENTAL EXAMPLE 2 | PET | * | 1000 mW/cm2 | 15 | CURED | 10 |
| EXPERIMENTAL EXAMPLE 3 | QUALITY PAPER | * | 1000 mW/cm2 | 15 | CURED | 7 |
| EXPERIMENTAL EXAMPLE 4 | OPP | FLUORESCENT LAMP | 12 mW/cm2 | 1 | 40 | 6 |
| EXPERIMENTAL EXAMPLE 5 | PET | FLUORESCENT LAMP | 12 mW/cm2 | 1 | 40 | 6 |
| EXPERIMENTAL EXAMPLE 6 | QUALITY PAPER | FLUORESCENT LAMP | 12 mW/cm2 | 1 | 40 | 5 |

TABLE 2-continued

| | RECORDING MEDIUM | LIGHT SOURCE | MAXIMUM IRRADIATION INTENSITY | DISTANCE FROM HEAD TO LIGHT SOURCE (cm) | VISCOSITY INCREASE RATE IN 0.1 SECOND | VISCOSITY INCREASE RATE IN 10000 SECONDS WITH LEAKED LIGHT |
|---|---|---|---|---|---|---|
| EXPERIMENTAL EXAMPLE 7 | OPP | * | 1000 mW/cm2 | 5 | CURED | 25 |
| EXPERIMENTAL EXAMPLE 8 | PET | * | 1000 mW/cm2 | 5 | CURED | 25 |
| EXPERIMENTAL EXAMPLE 9 | QUALITY PAPER | * | 1000 mW/cm2 | 5 | CURED | 10 |

Here, a way to calculate viscosity increase rate in the comparative examples 1 to 6 and the experimental examples 1 to 9 will be described. First, the above-mentioned light curable ink was filled in a stainless-steel case having an opening of 10 $cm^2$, and light having light intensity corresponding to leaked light which had been in advance measured at the jetted surface 31 of the recording head 3 was irradiated from the opening. Here, in the light intensity measurement, what was measured is ultraviolet ray intensity at a wavelength effective for curing the light curable ink. In the measurement, an UV power meter was used. After a predetermined time period had passed, with the use of a viscometer (MCR300 made by PHYSICA), viscosity of light curable ink at the temperature when the ink was being jetted was measured. Here, the light curable ink and the recording head 3 was heated up to 50° C. for jetting the ink, and the viscosity at 50° C. was measured. Based on the pre-measured viscosity, which was before the irradiation, and the viscosity after the irradiation, viscosity increase rate was obtained.

(Evaluation of Images)

In regard to each image of the comparative examples 1 to 6 and the experimental examples 1 to 9 recorded by the above-mentioned image recording method, each evaluation below was performed.

(Color Mixture (Bleeding))

By magnifying adjacent dots of each color with a loupe, bleeding degree was evaluated based on visual observation.

A: Shape of adjacent dots was maintained as a complete round, and there was no bleeding.

B: Shape of adjacent dots was maintained as approximately complete round, and there was hardly observable bleeding.

C: Adjacent dots are slightly bleeding and shape thereof was not entirely maintained but barely usable.

D: Adjacent dots were bleeding and mixing, and thereby not usable.

(Image Quality)

As image quality evaluation, with ink of each color of Y, M, C and K, letter of MS Mincho typeface at 6 points was printed, roughness of the letter was evaluated with a loupe, and letter quality was evaluated according to the standard below. Here, the printing was performed as much as 100 m of the recording medium P continuously, and at the points of 1 m, 10 m and 100 m, image quality was respectively evaluated.

A: There was no roughness.

B: There was hardly observable roughness.

C: Although there was some roughness, the letter was distinguishable and therefore barely usable.

D: There was roughness at an awful level. The letter was not distinguishable and thereby not usable.

The evaluation result is shown in TABLE 3.

TABLE 3

| | COLOR MIXTURE | 1 m IMAGE QUALITY | 10 m IMAGE QUALITY | 100 m IMAGE QUALITY |
|---|---|---|---|---|
| COMPARATIVE EXAMPLE 1 | A | C | D | D |
| COMPARATIVE EXAMPLE 2 | A | C | D | D |
| COMPARATIVE EXAMPLE 3 | A | C | D | D |
| COMPARATIVE EXAMPLE 4 | D | A | A | B |
| COMPARATIVE EXAMPLE 5 | D | A | A | B |
| COMPARATIVE EXAMPLE 6 | D | A | B | B |
| EXPERIMENTAL EXAMPLE 1 | B | A | A | B |
| EXPERIMENTAL EXAMPLE 2 | B | A | A | B |
| EXPERIMENTAL EXAMPLE 3 | C | A | B | B |
| EXPERIMENTAL EXAMPLE 4 | A | A | A | B |
| EXPERIMENTAL EXAMPLE 5 | A | A | A | B |
| EXPERIMENTAL EXAMPLE 6 | A | A | A | B |
| EXPERIMENTAL EXAMPLE 7 | A | A | A | B |
| EXPERIMENTAL EXAMPLE 8 | A | A | A | B |
| EXPERIMENTAL EXAMPLE 9 | A | A | A | B |

As it is possible to comprehend from the evaluation result of TABLE 3, in the comparative examples 1 to 3, it was not possible to maintain image quality for a long period, and in the comparative examples 4 to 6, there was color mixture occurring. However, in any of the experimental examples 1 to 9, it is possible to say that more suitable result was obtained than the comparative examples 1 to 6, comprehensively speaking.

In the above-mentioned experimental examples 1 to 9 and comparative examples 1 to 6, cationic polymerizing type ink was used. In experimental examples 10 to 15 and comparative examples 7 to 9 below, radical polymerizing type ink was used.

In the experimental examples 10 to 15 and the comparative examples 7 to 9, as ink of each color of yellow (Y), magenta (M), cyan (C), black (K) and white (W), used was radical polymerizing type ink obtained by blending each component at a ratio written in TABLE 4.

TABLE 4

| | | K | C | M | Y | W |
|---|---|---|---|---|---|---|
| COLOR MATERIAL | | 1 | 2 | 3 | 4 | 5 |
| ADDITION AMOUNT (wt %) | | 4 | 3 | 4 | 3 | 20 |
| RADICAL POLYMERIZABLE COMPOUND | TETRAETHYLENEGLYCOL DIACRYLATE | 35.9 | 36.9 | 35.9 | 36.9 | 19.9 |
| RADICAL POLYMERIZABLE COMPOUND | ϵ CAPROLACTAM DEGENERATED DIPENTAERYTHRITOL-HEXAACRYLATE | 20 | 20 | 20 | 20 | 20 |
| RADICAL POLYMERIZABLE COMPOUND | PHENOXYETHYL-METHACRYLATE | 30 | 30 | 30 | 30 | 30 |
| INITIATOR | IRGACURE 184 | 10 | 10 | 10 | 10 | 10 |
| SURFACTANT | MEGAFACE F1405 | 0.1 | 0.1 | 0.1 | 0.1 | 0.1 |

Irgacure 184 in TABLE 4 is made by Ciba Specialty Chemicals. Further, megaface F1405 is ethyleneoxide including perfluoroalkyl group.

Here, color materials 1 to 5, recording medium P and a light source 51 are the same as what is mentioned above.

Then, with a distance between the jetted surface 31 of the recording head 3 and the light source 51 set to 0.5 cm, 1 cm, 5 cm and 15 cm, and with the combination of the light source 51 and the recording medium P written in TABLE 5, an image was formed and comparative examples 7 to 9 and experimental examples 10 to 15 were obtained.

TABLE 5

| | RECORDING MEDIUM | LIGHT SOURCE | MAXIMUM IRRADIATION INTENSITY | DISTANCE FROM HEAD TO LIGHT SOURCE (cm) | VISCOSITY INCREASE RATE IN 0.1 SECOND | VISCOSITY INCREASE RATE IN 10000 SECONDS WITH LEAKED LIGHT |
|---|---|---|---|---|---|---|
| COMPARATIVE EXAMPLE 7 | OPP | * | 1000 mW/cm2 | 0.5 | CURED | 30 |
| COMPARATIVE EXAMPLE 8 | PET | * | 1000 mW/cm2 | 0.5 | CURED | 30 |
| COMPARATIVE EXAMPLE 9 | QUALITY PAPER | * | 1000 mW/cm2 | 0.5 | CURED | 15 |
| EXPERIMENTAL EXAMPLE 10 | OPP | * | 1000 mW/cm2 | 15 | CURED | 5 |
| EXPERIMENTAL EXAMPLE 11 | PET | * | 1000 mW/cm2 | 15 | CURED | 5 |
| EXPERIMENTAL EXAMPLE 12 | QUALITY PAPER | * | 1000 mW/cm2 | 15 | CURED | 3 |
| EXPERIMENTAL EXAMPLE 13 | OPP | * | 1000 mW/cm2 | 5 | CURED | 15 |
| EXPERIMENTAL EXAMPLE 14 | PET | * | 1000 mW/cm2 | 5 | CURED | 15 |
| EXPERIMENTAL EXAMPLE 15 | QUALITY PAPER | * | 1000 mW/cm2 | 5 | CURED | 6 |

(Evaluation of Images)

In regard to each image of the comparative examples 7 to 9 and the experimental examples 10 to 15 recorded by the above-mentioned image recording method, the above-mentioned color mixing and image quality were evaluated. The evaluation result is shown in TABLE 6.

TABLE 6

| | COLOR MIXTURE | 1 m IMAGE QUALITY | 10 m IMAGE QUALITY | 100 m IMAGE QUALITY |
|---|---|---|---|---|
| COMPARATIVE EXAMPLE 7 | A | C | D | D |
| COMPARATIVE EXAMPLE 8 | A | C | D | D |
| COMPARATIVE EXAMPLE 9 | A | C | D | D |
| EXPERIMENTAL EXAMPLE 10 | B | A | A | A |
| EXPERIMENTAL EXAMPLE 11 | B | A | A | A |
| EXPERIMENTAL EXAMPLE 12 | B | A | B | B |
| EXPERIMENTAL EXAMPLE 13 | A | A | A | A |
| EXPERIMENTAL EXAMPLE 14 | A | A | A | A |
| EXPERIMENTAL EXAMPLE 15 | A | A | B | B |

As it is possible to comprehend from the evaluation result of TABLE 6, in the comparative examples 7 to 9, it was not possible to maintain image quality for a long period. However, in any of the experimental example 10 to 15, it is possible to say that more suitable result was obtained than the comparative examples 7 to 9.

The entire disclosure of Japanese Patent Applications No. Tokugan 2003-130165 filed on May 8, 2003 and No. Tokugan 2004-108964 filed on Apr. 1, 2004 including specifications, claims, drawings and summaries are incorporated herein by reference in their entirety.

What is claimed is:

1. An image recording method, comprising:

jetting light curable ink on a recording medium by a recording head of an inkjet type;

irradiating light from a light source toward the recording medium; and curing the light curable ink to form an image, wherein at least one of light intensity of the light source and light curability of the light curable ink is adjusted so as to make viscosity increase rate of the light curable ink not less than 20% after the light source irradiates the light directly toward the light curable ink for a first predetermined time period; and light intensity at a jetted surface of the recording head is adjusted so as to make the viscosity increase rate of the light curable ink from 5% to 30% after light having the light intensity at the jetted surface is irradiated toward the light curable ink for a second predetermined time period which is longer than the first predetermined time period.

2. The method of claim 1, wherein the light curable ink includes cationic polymerizing type ink.

3. The method of claim 1, wherein the first predetermined time period is not more than 0.1 second, and the second predetermined time period is not less than 10000 seconds.

4. The method of claim 1, wherein at least one of the light intensity of the light source and the light curability of the light curable ink is adjusted so as to cure the light curable ink after the light source irradiates the light directly toward the light curable ink for a time period not less than the first predetermined time period and not more than 1.0 second.

5. The method of claim 1, wherein the light intensity at the jetted surface of the recording head is adjusted by adjusting at least one of a distance between the recording head and the light source, and an irradiation angle of the light source.

6. The method of claim 5, wherein the distance between the recording head and the light source is set to from 1 cm to 10 cm.

7. An image recording device comprising:

a recording head of an inkjet type, for jetting light curable ink toward a recording medium; and a light source for irradiating light toward the light curable ink jetted on the recording medium to cure the light curable ink, wherein at least one of light intensity of the light source and light curability of the light curable ink is adjusted so as to make viscosity increase rate of the light curable ink not less than 20% after the light source irradiates the light directly toward the light curable ink for a first predetermined time period, and light intensity at a jetted surface of the recording head is adjusted so as to make the viscosity increase rate of the light curable ink from 5% to 30% after light having the light intensity at the jetted surface is irradiated toward the light curable ink for a second predetermined time period which is longer than the first predetermined time period.

8. The device of claim 7, wherein the light curable ink includes cationic polymerizing type ink.

* * * * *